US007722369B2

(12) United States Patent
Bushby

(10) Patent No.: US 7,722,369 B2
(45) Date of Patent: May 25, 2010

(54) LOCK FOR SERIAL BUS CONNECTOR PLUGS

(76) Inventor: Donald P. Bushby, 1211 Nagle St., Houston, TX (US) 77003

( * ) Notice: Subject to any disclaimer, the term of this patent is extended or adjusted under 35 U.S.C. 154(b) by 738 days.

(21) Appl. No.: 11/504,494

(22) Filed: Aug. 15, 2006

(65) Prior Publication Data

US 2007/0037454 A1 Feb. 15, 2007

Related U.S. Application Data

(60) Provisional application No. 60/708,275, filed on Aug. 15, 2005, provisional application No. 60/709,663, filed on Aug. 19, 2005.

(51) Int. Cl.
*H01R 13/44* (2006.01)

(52) U.S. Cl. ..... 439/134; 439/135; 70/58

(58) Field of Classification Search ..... 439/131, 439/133, 134, 135, 144, 304; 70/24, 25, 70/32, 33, 34, 58
See application file for complete search history.

(56) References Cited

U.S. PATENT DOCUMENTS 4,679,873 A * 7/1987 Brackett, Jr. ..... 439/134
5,288,241 A * 2/1994 Davidge et al. ..... 439/304
5,435,744 A 7/1995 Derstine et al.
5,502,989 A 4/1996 Murray, Jr. et al.
5,507,656 A * 4/1996 Ales ..... 439/133
5,634,809 A 6/1997 Hirai
5,772,461 A 6/1998 Yu
6,522,532 B2 * 2/2003 Liao et al. ..... 361/679.43
6,619,976 B2 * 9/2003 Huetter et al. ..... 439/352
6,650,534 B2 * 11/2003 Tree ..... 361/679.4
6,796,152 B1 * 9/2004 Yu ..... 70/58
6,799,981 B1 * 10/2004 Yu ..... 439/133
6,808,400 B2 10/2004 Tu
6,902,432 B2 6/2005 Morikawa et al.
6,991,479 B2 * 1/2006 Miao ..... 439/133
7,014,490 B1 * 3/2006 Morikawa et al. ..... 439/352
7,275,941 B1 * 10/2007 Bushby ..... 439/133
7,300,306 B2 * 11/2007 Le et al. ..... 439/502
7,341,464 B2 * 3/2008 Cuellar et al. ..... 439/135
7,479,021 B2 * 1/2009 Huang ..... 439/133

(Continued)

OTHER PUBLICATIONS

Digital Innovations LLC, SecurityDR Data Guard™ Thumbdrive Lock, press release Sep. 12, 2005, www.digitalinnovations.com.

*Primary Examiner*—James Harvey
(74) *Attorney, Agent, or Firm*—Glenn L. Webb

(57) ABSTRACT

Lock devices for installation on a serial bus male connector plug that prevent access to, and connection of the plug to other devices, such as memory storage devices, have a housing with a receptacle which is installed onto the serial bus male connector plug to cover at least a portion of the male connector plug, and contain a locking mechanism and retaining member moveable between an unlocked position allowing disengagement and removal of the plug from the receptacle, and a locked position with plug securely engaged in the receptacle to prevent connection of the connector plug to a female serial bus connector of another device and unauthorized access to data stored in the memory of memory storage devices. The lock device may have a shackle and a cap-holding tether attachment and may be utilized with conventional security cables and locking devices to also prevent theft of the memory storage device.

20 Claims, 6 Drawing Sheets

U.S. PATENT DOCUMENTS

2004/0074264 A1 4/2004 Kung et al.
2006/0036872 A1 2/2006 Yen
2007/0037454 A1* 2/2007 Bushby ..... 439/680

* cited by examiner

LOCK FOR SERIAL BUS CONNECTOR PLUGS

CROSS REFERENCE TO RELATED APPLICATIONS

This application claims priority of U.S. Provisional Application Ser. No. 60/708,275, filed Aug. 15, 2005, and U.S. Provisional Application Ser. No. 60/709,663, filed Aug. 19, 2005.

BACKGROUND OF THE INVENTION

1. Field of the Invention

This invention relates generally to security systems for memory storage devices, and more particularly to a lock for a male serial bus connector plug that prevents connection of the plug to other devices, such as memory storage devices to prevent transfer of stored data and/or media, and the locks may be equipped with a shackle to also prevent theft of portable memory storage devices.

2. Background Art

As used herein, the term "memory storage device" refers to small portable devices and non-portable devices having the capability to store large amounts of digital data and/or media, such as data files, image files, music files, and video files, and which are equipped with a connector plug such as, for example, a Universal Serial Bus (USB) male connector plug for uploading or downloading digital data and/or media between the memory storage device and a computer or other device. As used herein, the terms "other device", "another device", or "external device" refers to any device which is equipped with a female connector such as, for example, a Universal Serial Bus (USB) female connector that receives the male connector plug for uploading or downloading digital data and/or media to or from the memory storage device.

Examples of non-portable memory storage devices are a desktop or laptop computer hard drive, or an external hard drive, or a data transfer cable. Examples of portable memory storage devices include: "flash drives", also known as "thumb drives", "flash disks" or "pen drives", "mini hard drives", and portable audio players, portable video players, digital cameras, personal digital assistants (PDA), and cell phones.

These types of portable memory storage devices have increased dramatically in capability and popularity, while decreasing in size and expense. Due to their small size, these types of devices are also susceptible to theft or misplacement, and moreover, unauthorized use and/or downloading valuable files, digital data and/or media stored thereon by simply connecting the device to a computer or other device, without detection by the owner.

There are currently five different types of Universal Serial Bus (USB) male plug connectors in standard sizes, known as a "USB-A-Male", "USB-B-Male", "Mini USB-A-Male" and "Mini USB-B-Male".

Some non-portable memory storage devices and most conventional portable memory storage devices of the type discussed above equipped with a male connector plug include a means of covering the plug to protect it from damage and prevent accumulation of dirt or debris. For example; simple covers or caps that slip over the end of the male connector plug, a pivotal cover or sheath that encloses the male plug when stored and allows it to pivot outward therefrom to expose the plug for use, and a retractable cover or sheath which allows the male connector plug to be retracted inside the sheath in a stored position and is extensible outwardly therefrom for use. These types of covers, caps and sheaths, do not prevent unauthorized access to, and/or connection of the connector plug to external devices, nor prevent unauthorized access to the data and/or media stored in the device memory, nor prevent theft of the device.

There are several known devices for tethering or securing the portable memory device to a stationary object, such as a desk, workstation, or computer housing or case to prevent theft or misplacement of the memory device. A popular commercially available cable system is made by Kensington, of San Mateo, Calif. and described in U.S. Pat. No. 5,502,989. The cable is terminated at one end with a securing attachment to an anchor point on the valuable item and the other cable end is terminated with a locking device that attaches securely to the anchor point. The steel cable is arranged to loop around some large, preferably immovable object thus rendering the valuable item more difficult to steal.

Kung, U.S. Published Patent application 20040074264 discloses a portable data storage device, such as a pen drive or thumb drive, having a latching device that captures and traps a key-ring or security cable passing through the end opposite the USB plug that securely attaches the data storage device to deter theft of the storage device, without the need to unlock the security cable's lock.

While these types of tethering devices may be effective in preventing theft, removal, or misplacement of the memory device, they do not prevent unauthorized access to, and/or connection of the connector to external devices and thus, do not prevent theft the data and/or media stored in the device memory. An unauthorized person could still use and/or download valuable files, digital data and/or media stored on the memory device by simply connecting it to a laptop computer or other host device, without detection by the owner.

There are also several known methods employed for securing or preventing theft of the data or media stored on portable memory devices, which include: encryption, password protection, and biometric identification devices and methods. Although these methods are may be suitable for preventing unauthorized access to the data and/or media stored on the device, they do not prevent unauthorized access to and/or connection of the male serial bus connector to other devices and do not prevent theft of the attached memory device.

Yen, U.S. Published Patent application 20060036872 discloses an anti-burglary USB flash drive with a press-button type electronic combination lock that adopts an IC password circuit without requiring a driver program for achieving the effects of preventing burglary and protecting confidential data stored in the USB flash drive by means of entering a password into a main body of the USB flash drive. A programmable logic IC in the main body of the USB flash drive checks the password, and if the password is correct, then the user is permitted to access the data stored in the USB flash drive.

Morikawa et al, U.S. Pat. Nos. 7,014,490 and 6,902,432 discloses a USB connector equipped with a latching or lock mechanism. The USB connector includes a receptacle having a shell and a receptacle terminal; a plug that includes a plug shell for fitting into the receptacle shell and a plug terminal; and an engagement release member that is provided on the plug shell so as to be movable between an engagement releasing position and an engagement position. When the plug is fitted into the receptacle, the plug terminal is electrically connected to the receptacle terminal. The plug shell has a retaining portion and the receptacle shell has an engagement portion, which is engaged with the retaining portion when the plug is fitted into the receptacle. The engagement release member maintains engagement of the retaining portion with the engagement portion in an engagement position, and the release member releases the engagement in an engagement releasing position.

Huetter et al, U.S. Pat. No. 6,619,976 discloses an apparatus and method for preventing inadvertent disconnection of male and female electrical connectors. In one embodiment, the devices are configured to provide outside retaining forces to retention prongs of a female electrical connector, substantially restricting or preventing the retention prongs from moving toward an outer non-holding position after connecting with receiving portions in the male connector. In another embodiment, the female electrical connector includes modified retention prongs having a portion configured to enter and remain in surface holes of the male connector so that the male connector, once inserted, cannot be removed from the female connector without a user manipulating the modified retention prongs.

Yu, U.S. Pat. No. 5,772,461 discloses a locking mechanism for interconnecting two mated connectors. A first receptacle connector includes a first main body having a first projecting section on the front portion, and a second plug connector includes a second main body having a second projecting section on the front portion wherein a hook device is provided on the first projecting section of the first receptacle connector and a locking slot is provided on the second projecting section of the second plug connector, and said second projecting section of the second plug connector further includes a release device which can incorporate the hook device of the first projecting section of the first receptacle connector to unhook the engagement between the hook of the first projecting section of the first receptacle and the locking slot of the second projecting section of the second plug connector.

Hirai, U.S. Pat. No. 5,634,809 discloses a connector with a lock mechanism having a connector main body in which are mounted electric contacts, a shield member for covering the connector main body and a connecting portion between the electric contacts and a cable, a casing for enclosing the connector main body and the shield member; and a lock mechanism for locking or unlocking a connection of the connector to a mating connector. The lock mechanism is made up of a flexible lock piece, one end of which is connected to the shield member; a pair of lock release slide plates which are slidable along upper and lower main surfaces of the casing; and slide members which slide inside the casing by sliding of the slide plates so as to release the locking by the lock piece.

Derstine et al, U.S. Pat. No. 5,435,744 discloses an overlying sliding boot assembly or cover for an electrical cable connector of the type that mates with and latchably engages a complementary connector. The connector includes a dielectric housing containing an array of electrical contacts for electrical engagement with respective contacts in a complementary connector. The connector further comprises a pair of unitary metal shielding members, a first one has a pair of latching arms extending from a mating end toward a cable receiving end, and a pair of hermaphroditic cover members formed of a dielectric material adapted to interfit together about the electrical connector in sliding engagement therewith, and movable from a first position to a second position to effect unmating of the electrical connector from the header assembly. Each cover member includes a latching arm receiving recess, and a flexible arm engageable with a complementary recess in the opposing cover member. Manual movement of the assembled cover members to the second position causes the respective flexible arms to flex from their released position. Releasing the assembled cover members effects a return of the assembled cover members to the first position.

The covers and locking arrangements of the aforesaid patents and published applications are lock mechanism that merely operate to lock or unlock the connector to a mating connector to hold them together and prevent accidental detachment. They do not prevent unauthorized access to and/or connection of the male connector plug to an external device, nor prevent unauthorized access to the data and/or media stored on the device equipped with the mating connector.

In a press release dated Sep. 12, 2005, less than one year prior to the effective filing date of the present application, Digital Innovations LLC, of Arlington Heights, Ill. introduced a mechanical combination lock known as the SecurityDR Data Guard™ Thumbdrive Lock, which locks over the USB end of a thumbdrive and is released by a pushbutton.

The present invention overcomes the aforementioned problems and is distinguished over the prior art in general, and these patents in particular by a lock for serial bus male connector plugs that prevents access to, and connection of the plug to the mating female connector of another device, such as a memory storage device. The present lock devices are void of any electrical connections and have a housing with a receptacle which is installed onto the serial bus male connector plug to cover at least a portion of the male connector plug and contains a locking mechanism which may be a combination lock or a key lock mechanism moveable between an unlocked position allowing disengagement and removal of the plug from the receptacle, and a locked position with the receptacle covering at least a portion of the male connector plug and preventing disengagement and removal therefrom to prevent connection of the connector plug to a mating female serial bus connector. The lock device may or may not have a shackle and, if provided with a shackle, and installed on a portable memory storage device, may be utilized in conjunction with conventional security cables and locking devices to also prevent theft of the memory storage device in its locked condition.

SUMMARY OF THE INVENTION

The present invention concerns lock devices that can be attached to a serial bus male connector plug to cover at least a portion of the plug to prevent access and connection of the plug to a female connector of another device, such as a memory storage device, for accessing and transferring digital data between the memory storage device and other devices. The lock device may be a combination lock or a key lock and may or may not have a shackle. The lock device, in an unlocked condition, allows connection of the connector plug to another device and, in a locked condition, covers at least a portion of the connector plug to prevent connection of the connector plug to other devices and, thereby prevents unauthorized access to stored data and media.

The lock devices of the present invention, when equipped with a shackle and installed on a portable memory device, can also be utilized with a security cable, which is securely anchored to another object, or connected to any suitable object, such as a briefcase, computer bag, handbag, etc., in order to prevent the unauthorized removal or theft of memory storage devices.

The lock devices may also be equipped with a tether attachment for holding the removable cover or cap of a portable memory storage device to prevent it from being misplaced or lost when the lock is installed on the portable memory device.

The lock devices of the present invention are void of any electrical connections and can be used in conjunction with other existing forms of memory security including encryption software, password protection, and biometric identification devices and methods.

The present lock devices may be packaged and sold together with a memory storage device as a kit for the convenience of the consumer.

Other objects and advantages of the invention will become apparent from time to time throughout the specification and claims as hereinafter related.

BRIEF DESCRIPTION OF THE DRAWINGS

The novel features believed to be characteristic of the invention are set forth in the appended claims. The present invention itself, however, as well as a preferred mode of use, further objectives, and advantages thereof, will best be understood by reference to the following detailed description of preferred embodiments when read in conjunction with the accompanying drawings.

DESCRIPTION OF THE PREFERRED EMBODIMENTS

Figure 1:
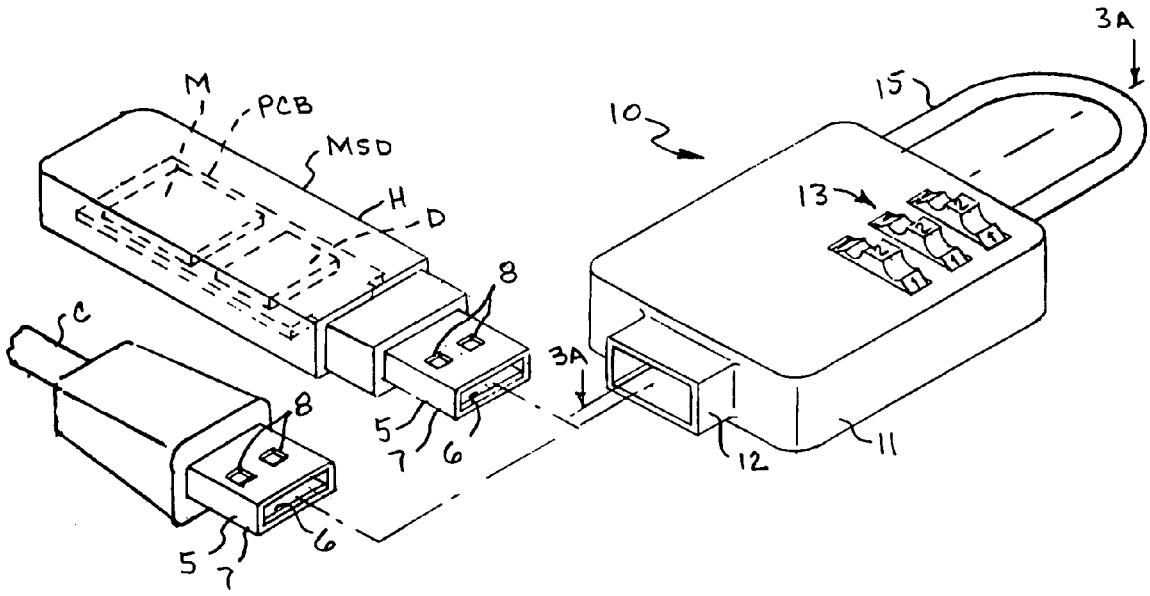
FIG. 1 is an isometric view of a portable memory storage device and a data transfer cable each having a Universal Serial Bus (USB) male connector plug and a combination lock device in accordance with a first embodiment of the invention, shown in an unlocked position with the lock device removed from the plug.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The male connector plug depicted in the drawing figures is shown and described, for purposes of example, as a Universal Serial Bus (USB) plug, and it should be understood that the male connector plug may be of any type that has one or more holes in its case and is capable of being to a mating female connector of another device which may be interconnected with the memory storage member of a memory storage device for accessing and transferring digital data. The male plug connector may be located on a memory storage device or at one end of a data transfer cable connected with the memory storage device, or devices that may or may not contain memory, such as a keyboard, card reader, USB hub, etc.

It should also be understood that the interior components of the memory storage devices described herein, the electronic circuitry, and connector plug details are of standard conventional construction and well known in the art, and therefore, are represented somewhat schematically and not shown or described in detail.

Referring to the drawings by numerals of reference, there is shown in FIG. 1, an example of a memory storage device MSD in the form of a conventional portable memory storage device and a conventional data transfer cable C, each having a standard Universal Serial Bus (USB) male connector plug 5, and a combination lock device 10 in accordance with a first embodiment of the invention, shown in an unlocked position with the lock device removed from the connector plug.

In the illustrated example, the memory storage device MSD is depicted as a portable memory storage device having a main body or housing H in which is housed one or more printed circuit boards PCB, which include a memory means M such as a memory IC (integrated circuit) or a memory chip or disk, a controller or driver IC D, and a standard serial bus male connector plug 5 such as, for example, a USB (Universal Serial Bus) connector plug. The male connector plug 5 may be mounted or connected at one end with the PCB, and a part of the plug protrudes through an opening at one end of the body or housing, or is movable relative thereto, to be inserted into a mating female socket or port on an external device, such as a computer or other device for transferring digital data between the memory storage and external device. The male serial bus connector 5 may also be located at one end of a conventional data transfer cable C, which has another end connected with the memory storage of a memory storage device (not shown).

It should be understood that the portable memory device is illustrated for purposes of example only, and that the memory storage device MSD may be any type of non-portable memory storage device or portable memory storage device which is equipped with a Universal Serial Bus (USB) male connector plug 5, such as desktop or laptop computer hard drive, an external hard drive, or a data transfer cable connectable to a memory storage device, and the male connector plug 5 may be located on devices that may or may not contain memory, such as a keyboard, card reader, USB hub, etc.

The USB connector plug 5 may be a standard "USB-A-Male", "USB-B-Male", "Mini USB-A-Male" and "Mini USB-B-Male". The principal mechanical and electrical characteristics of these connectors are standardized according to a convention well known in the art. The male connector plug 5 contains a small connector substrate 6, which is often white ceramic, black rigid plastic, or another sturdy substrate, which has a four or more metal contacts formed thereon that carry the USB signals generated or received by the controller or driver chip D. The USB connector plug 5 also has a metal case 7 wraps around connector substrate 6 and has top and bottom surfaces, each having a pair of apertures 8, typically rectangular holes therethrough, which become aligned with detents of the retention prongs of the USB female connector (not shown) when the male connector plug is fully inserted. Typically, there is a relatively large gap or space between the top side of the connector substrate 6 holding the metal contacts and the top surface of the metal case 7 to accommodate mating electrical connections found in the female connector.

Referring additionally to FIGS. 3A, 3B, 4A and 4B, the lock device 10, in the first embodiment of the invention, has a housing 11 with a socket or receptacle 12 that receives and covers at least a portion of the male connector plug 5 and contains a locking mechanism 13, which in this embodiment is a combination lock mechanism 13 (described hereinafter).

The socket or receptacle 12 has top 12A and bottom 12B surfaces, and a pair of resilient retention prongs 14 formed in the top surface 12A each having a detent or protrusion 14A at one end for holding the male connector plug 5. In this embodiment, the protrusions 14A are disposed in inward facing relation with respect to the receptacle 12 to be received in the holes 8 in the top surface of the metal case 7 of the plug 5 when inserted into the receptacle. The resilient retention prongs 14 and protrusions 14A may be cut and formed of resilient metal or other suitable resilient material.

As shown in 3A and 3B, the combination lock mechanism 13, which is represented somewhat schematically, is of conventional construction and operation known in the art, and therefore all of the interior mechanical components are not shown or described in detail. The combination lock mechanism 13 includes a dial assembly which, in the illustrated example, includes three dials wheels 13A rotatably mounted in a series of recesses in the housing 11 and the longer leg 15A of a J-shaped shackle 15 is received through the dial wheels and is movable axially relative to the housing. As is conventional in the art, each of the dial wheels 13A has a plurality of slots along its inner surface and the longer leg 15A of the shackle includes a plurality of sections each having a lengthwise locking fin on its surface, the locking fins being aligned and snugly fitted in the slots (conventional and therefore not shown). The shorter leg 15B of the shackle 15 has a terminating end received in a hole 11A in the end of the housing 11 in a locked position. When the shackle 15 is in its unlocked position, the terminating end of its shorter leg 15B is positioned above the hole 11A in the lock housing.

Figure 3A:
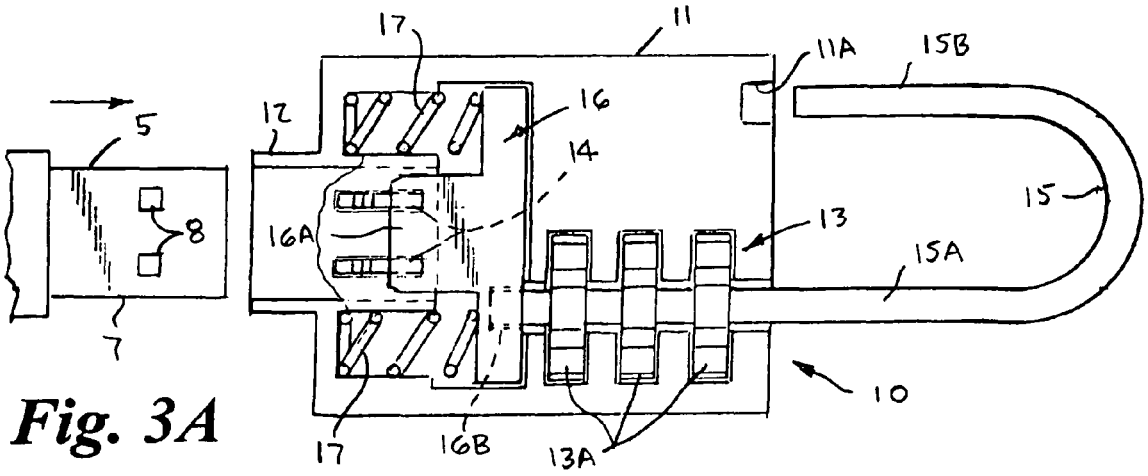
FIGS. 3A and 3B are top plan views of the lock device of FIG. 1, taken along line 3A-3A, with the top wall of the lock housing removed to show the locking and retaining components of the combination lock in an unlocked position and a locked position, respectively.
Figure 4A:
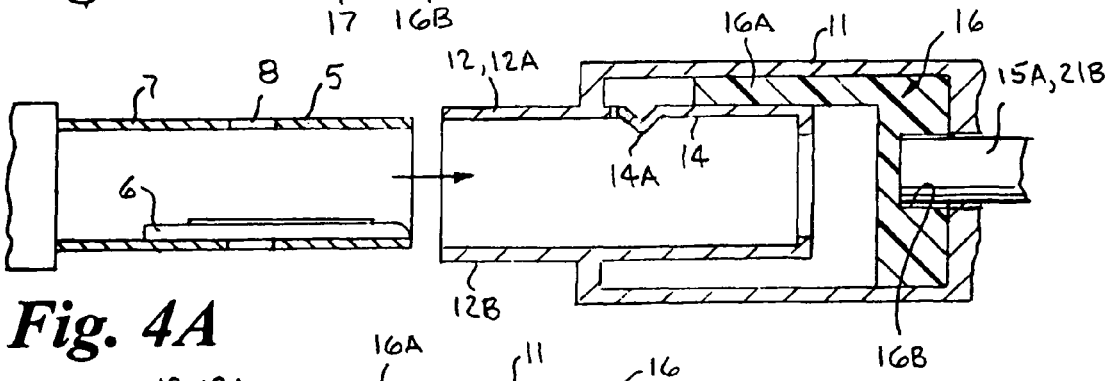
FIGS. 4A and 4B are enlarged longitudinal cross sectional views of the receptacle portion of the lock and the Universal Serial Bus (USB) male connector plug in the unlocked position and the locked position, respectively.

A generally T-shaped retaining member 16 is slidably mounted in a recess in the housing 11 and has a central generally rectangular outwardly extending plate or tongue portion 16A at one end which is slidably received on the top surface 12A of the receptacle 12 adjacent to the retention prongs 14. A small bore 16B is formed in the inward facing end of the retaining member 16 and receives the end of the longer leg 15A of the shackle 15. A pair of compression springs 17 are mounted in recesses in the housing 11 at lateral sides of the receptacle 12 and each has one end engaged on the housing and their opposed end engaged on a respective lateral side of the retaining member 16 to normally urge the retaining member to a retracted position and the shackle 15, in its unlocked condition, to an outwardly extended position relative to the housing, as shown in FIGS. 3A and 4A.

Figure 3B:
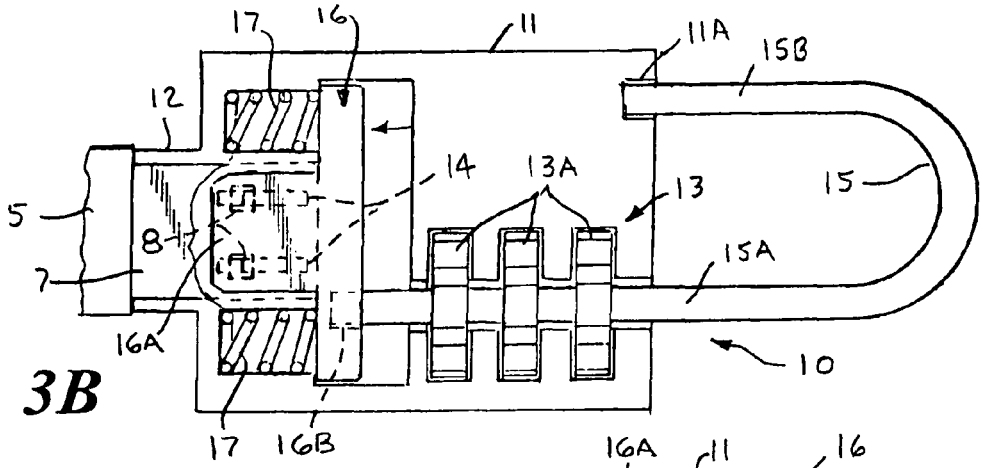
Figure 4B:
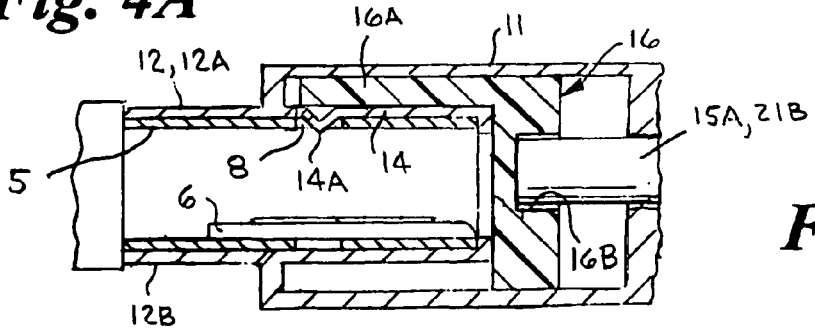
Figure 5A:
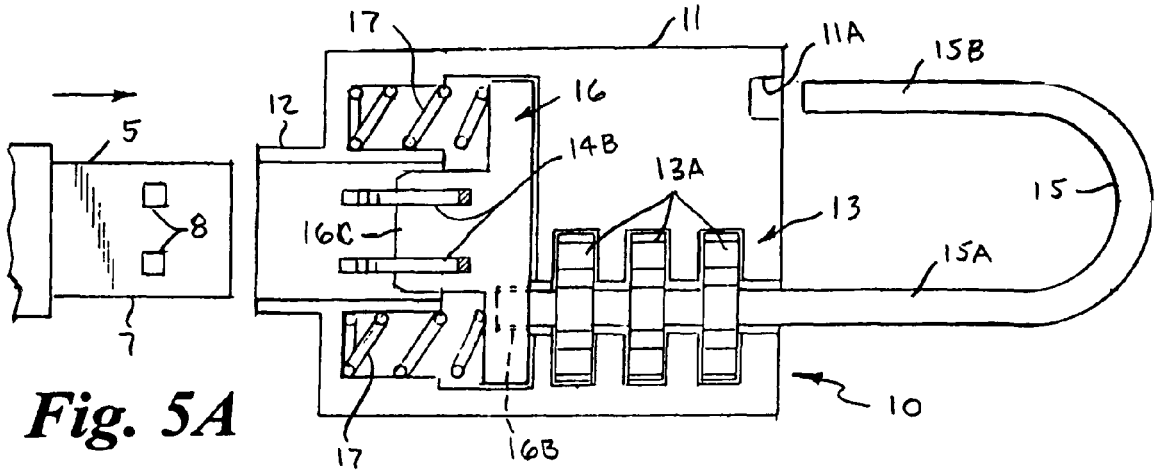
FIGS. 5A and 5B are top plan views of the lock device of FIG. 1 having a modified retaining arrangement, with the top wall of the lock housing removed to show the locking and retaining components of the combination lock in an unlocked position and a locked position, respectively.
Figure 5B:
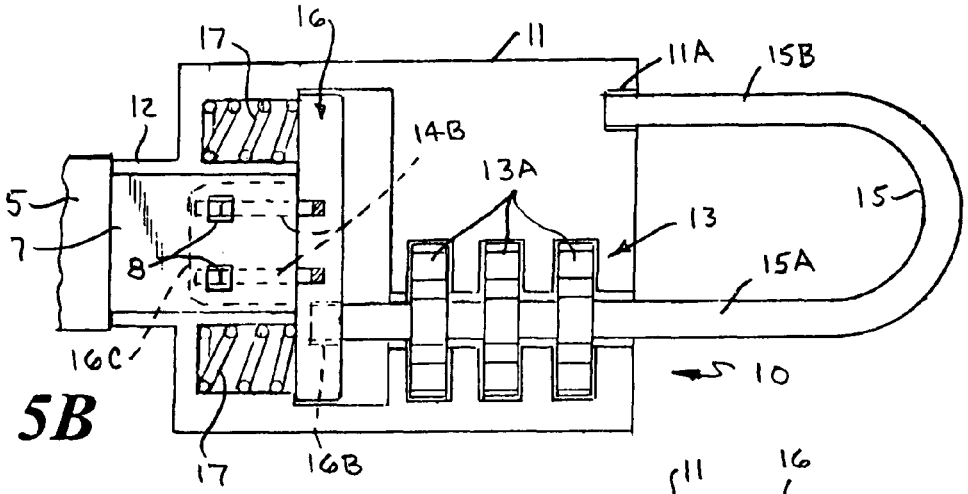
Figure 6A:
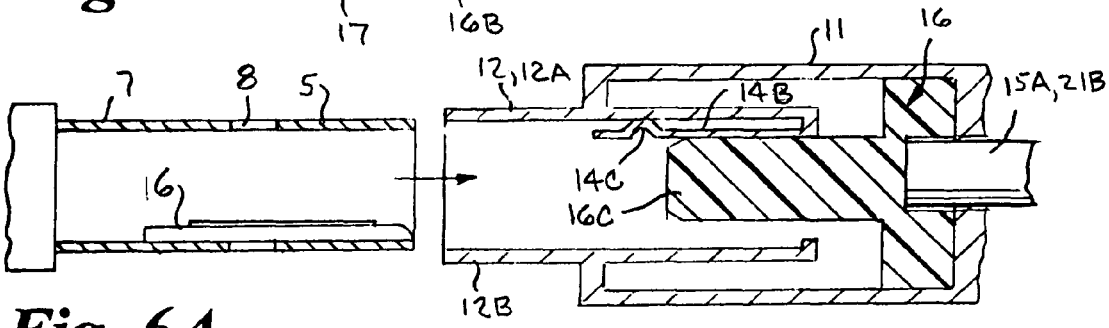
FIGS. 6A and 6B are enlarged longitudinal cross sectional views of the receptacle portion of the lock of FIG. 5A shown in the unlocked position and the locked position, respectively.
Figure 6B:
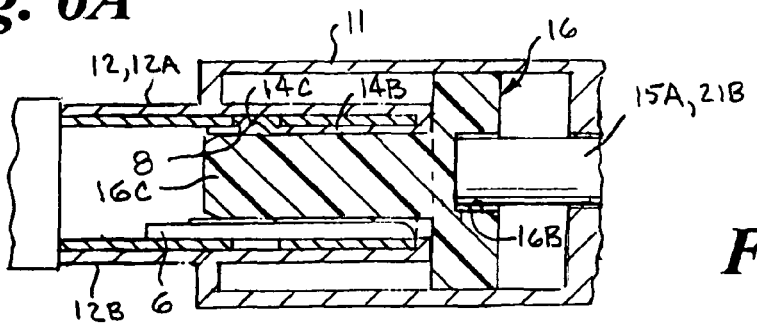

Referring additionally to FIGS. 3B and 4B, the male connector plug 5 is inserted into the receptacle 12 when the shackle 15 is in its outward, unlocked position, until the protrusions 14A of the retention prongs 14 snap into and engage the holes 8 in the top surface of the plug.

Whenever secure, locked engagement of the plug 5 with the lock 10 is desired, the shackle 15 is moved from its outward open position to its inward, closed position. This movement causes the longer leg 15A of the shackle 15 to move inwardly relative to the housing 11, and the retaining member 16 to move axially outward such that its tongue portion 16A is moved to a locking position covering a sufficient portion of the retention prongs 14 to retain the protrusions 14A in the engaged position in the holes 8 of the plug 5. As result of this movement, the plug 5 is captured within the receptacle 12 in secure, locked engagement, and is incapable of being withdrawn until the preset combination is dialed by operation of the dial wheels 13A.

Whenever the user desires to remove the lock 10 from secure engagement with the plug 5, the dial wheels 13A are rotated to display the pre-set combination, thereby enabling the shackle 15 and the retaining member 16 to be axially movable under pressure from the springs 17 relative to the housing 11 from the locking position to the unlocked position. This axial movement causes the terminating end of the shorter leg 15B of the shackle 15 to be raised clear of the hole 11A in the housing 11 and the retaining member 16 to be retracted such that its tongue portion 16A uncovers a substantial portion of the retention prongs 14, and the plug 5 can be pulled outwardly relative to the receptacle 12 to disengage the protrusions 14A and removed from the lock device. When the lock device and the plug are separated, the plug can then be connected with a mating female serial bus connector.

The lock device 10 may also be installed on the plug 5 with the locking mechanism in an unlocked condition to serve as a removable cover, wherein the protrusions 14A of the retention prongs 14 snap into and engage the holes 8 in the top surface of the plug to prevent accidental disconnection, but allow the lock to be removed with only a moderate pulling force.

Referring now to FIGS. 5A, 5B 6A and 6B, there is shown a modification of the receptacle 12 and retaining member 16 of the lock device 10. In this modification, a pair of resilient retention prongs 14B are disposed on the inside of receptacle 12 just beneath its top surface and the protrusions 14C are disposed in outwardly facing relation to be received in the holes 8 in the top surface of the metal case 7 of the plug 5 from the underside thereof.

In this modification, retaining member 16 has a generally rectangular outwardly extending tongue portion 16C which is disposed in a position to be slidably received inside of the receptacle 12 and on the underside of the retention prongs 14B. When the longer leg 15A of the shackle 15 is moved inwardly relative to the housing 11, the retaining member 16 moves axially outward such that its tongue portion 16C is moved to a locking position covering a sufficient portion of the retention prongs 14B to retain the protrusions in the engaged position in the holes 8 of the plug 5.

All of the other components are the same as described previously and are assigned the same numerals of reference, and operate as described previously, but will not be described again in detail to avoid repetition.

In the embodiments equipped with a shackle, a security cable may optionally be secured to the shackle of the lock, whereby the memory device secured to the lock can also be secured to another object, such as a computer, desk, briefcase, purse, etc., to prevent theft of the memory storage device.

Figure 2:
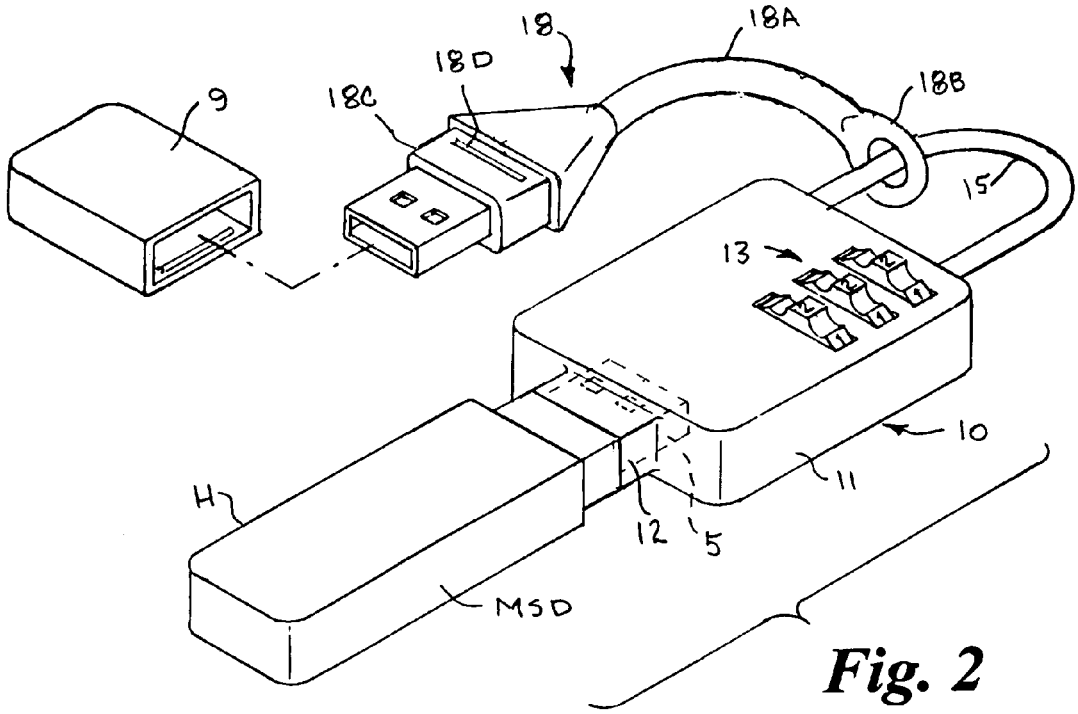
FIG. 2 is an isometric view of the memory storage device of FIG. 1 shown in the locked position with the lock device secured over the end of the male connector plug and locked thereon, and also showing a tether attached to the shackle of the lock for holding the removable cap of the memory storage device.

Referring again to FIG. 2, many portable memory storage devices MSD equipped with a male serial bus connector plug 5 include a removable cover or cap 9 that slips over the end of the male connector plug to protect it from damage and prevent accumulation of dirt or debris. These removable caps often get misplaced or lost. As shown in FIG. 2, a tether 18 may also be provided for use with the lock devices, which will hold the removable cap 9 when the lock device is installed. The tether 18 is formed of a flexible cord or strap 18A having a loop or eyelet 18A at one end and a male receptacle 18B at the opposite end one. The male receptacle 18B is sized and shaped to somewhat resemble a conventional serial bus plug and may be provided with a grooved surface 18C for engaging the interior of a conventional cap 9. The tether may be molded of a suitable flexible material, or may be formed of a flexible cable having a loop or eyelet at one end and the male receptacle at the opposed end. It should be understood that the end 18A of the tether may be attached to the housing of the lock device in various other ways, such as by conventional fasteners, rather than being attached to the shackle.

Figure 7A:
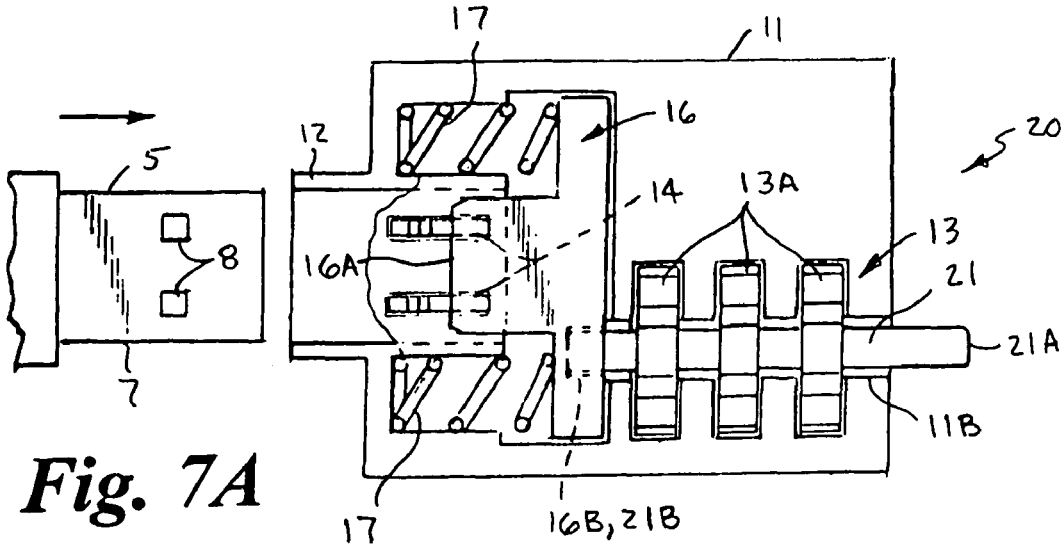
FIGS. 7A and 7B are top plan views of an alternate embodiment of the combination lock device that has a push button and does not have a shackle, with the top wall of the lock housing removed to show the locking and retaining components of the combination lock in an unlocked position and a locked position, respectively.
Figure 7B:
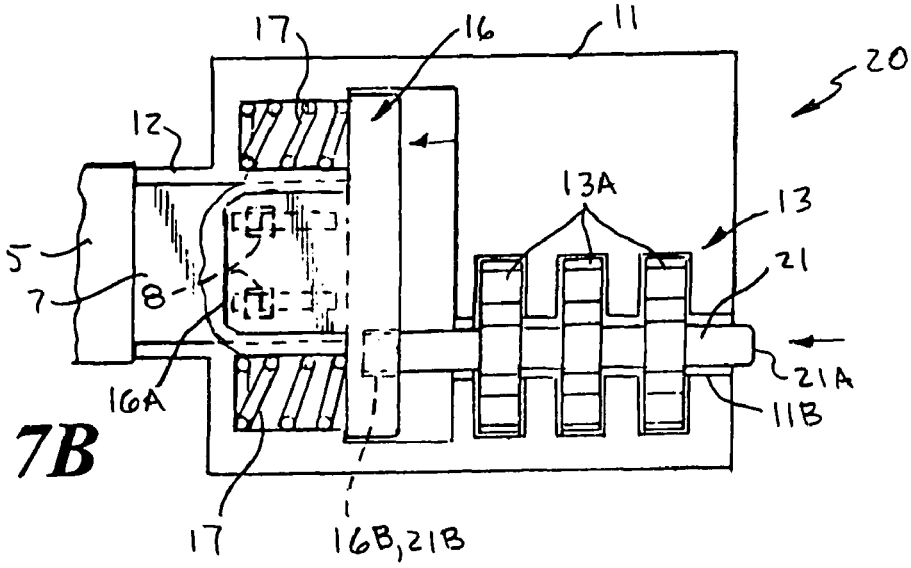

Referring now to FIGS. 7A and 7B, there is shown an alternate embodiment of the combination lock device 20 that has a push button and does not have a shackle. For purposes of example, the push button locking mechanism is shown in combination with the retaining member 16 having a tongue portion 16A that extends over the top of the receptacle 12 as shown and described previously with reference to FIGS. 3A, 3B, 4A and 4B. However, it should be understood that the push button locking mechanism may also be incorporated in combination with the retaining member 16 having a tongue portion 16C that extends inside of the receptacle 12 as shown and described previously with reference to FIGS. 5A, 5B, 6A and 6B.

In this embodiment, an elongate rod 21 that is movable axially relative to the housing replaces the shackle. All of the other components of this embodiment are the same as described previously and are assigned the same numerals of reference, but will not be described again in detail to avoid repetition. The rod 21 is received through the dial wheels 13A and, like the shackle, includes a plurality of sections each having a lengthwise locking fin on its surface, the locking fins being aligned and snugly fitted in slots in the dial wheels (conventional and therefore not shown). The rod 21 has one end 21A extending through a hole 11B in the lock housing 11 to serve as a manual push button, and its opposed end 21B is received in the hole 16B in the retaining member 16, as shown and described previously. The compression springs 17 urge the retaining member 16 to a retracted position and the rod 21, in its unlocked condition, to an outwardly extended position relative to the housing, as shown in FIG. 7A. When the rod 21 is in its unlocked position, its outer end 21A is extended outwardly from the lock housing 11. The male connector plug 5 is inserted into the receptacle 12 when the rod 21 is in its outward, unlocked position, until the protrusions 14A (or 14C) of the retention prongs 14 (or 14B) snap into and engage the holes 8 in the top surface of the plug 5, as shown and described previously.

As shown in FIGS. 7B, 4A and 4B, 6A and 6B, whenever secure, locked engagement of the male connector plug 5 with the lock 20 is desired, the rod 21 is pushed inwardly by manually pressing its outer end 21A, causing the retaining member 16 to move axially outward such that its tongue portion 16A or 16C is moved to a locking position covering a sufficient portion of the retention prongs 14 or 14B to retain the protrusions 14A or 14C in the engaged position in the holes 8 of the plug 5 and the plug is captured within the receptacle in secure, locked engagement, and is incapable of being withdrawn until the preset combination is dialed by operation of the dial wheels.

Whenever the user desires to remove the lock 20 from secure engagement with the male connector plug 5, the dial wheels 13A are rotated to display the pre-set combination, thereby enabling the rod 21 and the retaining member 16 to be axially movable relative to the housing 11 under pressure from the springs 17 from the locking position to the unlocked position such the tongue portion 16A or 16C of the retaining member 16 uncovers a substantial portion of the retention prongs 14 or 14A, and the plug 5 can be pulled outwardly relative to the receptacle to disengage the protrusions and removed from the lock device.

Referring now to FIGS. 8, 8A, 8B, 9A and 9B, there is shown an alternate embodiment of the lock device 30 that has a key-operated lock mechanism. The lock mechanism is of conventional construction and operation known in the art, and therefore all of the interior mechanical components are not shown or described in detail. For purposes of example, the key-operated lock mechanism is shown in combination with the retaining member 16 having a tongue portion 16A that extends over the top of the receptacle 12 as shown and described previously with reference to FIGS. 3A, 3B, 4A and 4B. However, it should be understood that the key-operated lock mechanism may also be incorporated in combination with the retaining member 16 having a tongue portion 16C that extends inside of the receptacle 12 as shown and described previously with reference to FIGS. 5A, 5B, 6A and 6B.

Figure 8:
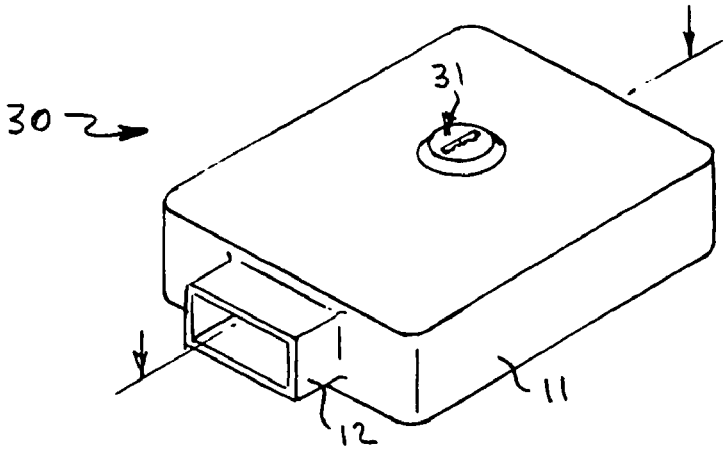
FIG. 8 is an isometric view of an alternate embodiment of the lock device having a key-operated locking mechanism.
Figure 8A:
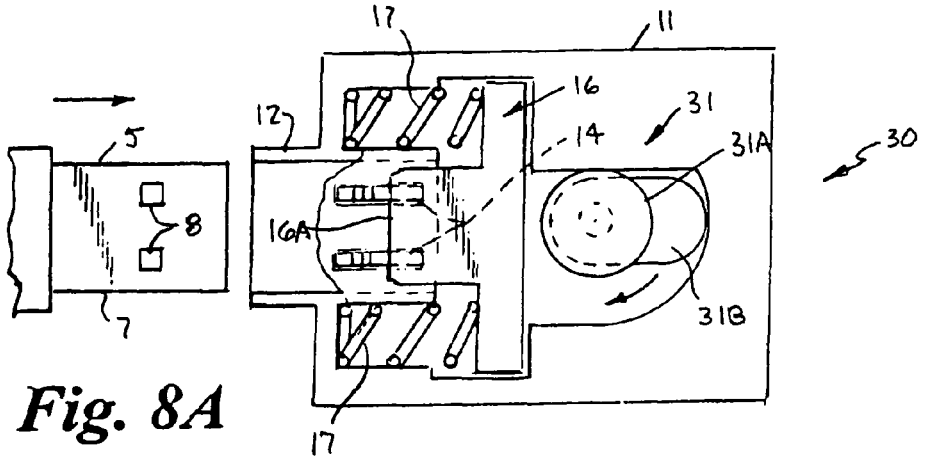
FIGS. 8A and 8B are top plan views of the key-operated lock device of FIG. 8, with the top wall of the lock housing removed to show the locking and retaining components of the key-operated lock in an unlocked position, and a locked position, respectively.
Figure 9A:
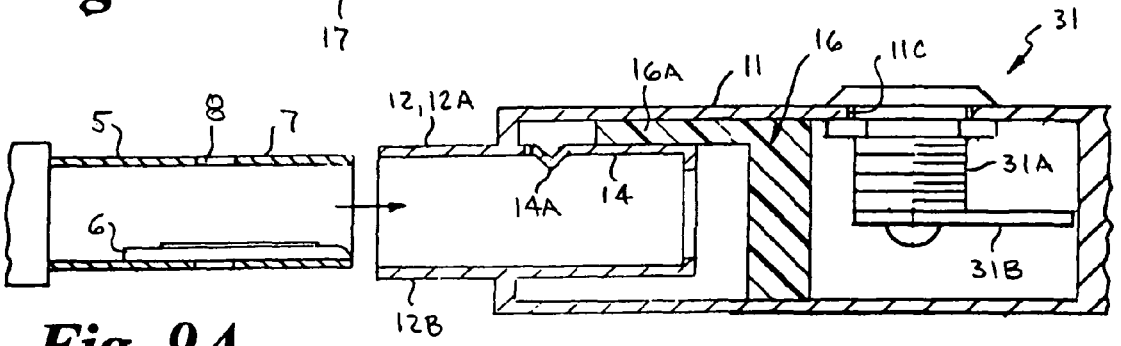
FIGS. 9A and 9B are enlarged longitudinal cross sectional views of the receptacle portion of the lock of FIG. 8 shown in the unlocked position, and the locked position, respectively.

In this embodiment, a conventional keyed cylinder lock 31 is mounted in a hole 11C in the top wall of the lock housing 11. The keyed cylinder lock 31 includes a conventional cylinder 31A and a rotatable latch element 31B at its bottom end that extends laterally outward from the bottom end. In an unlocked position, the outer end of the latch element 31B is positioned away from the inward facing surface of the retention member 16, and the compression springs 17 urge the retaining member 16 to a retracted position relative to the housing 11, as shown in FIGS. 8A and 9A.

Figure 8B:
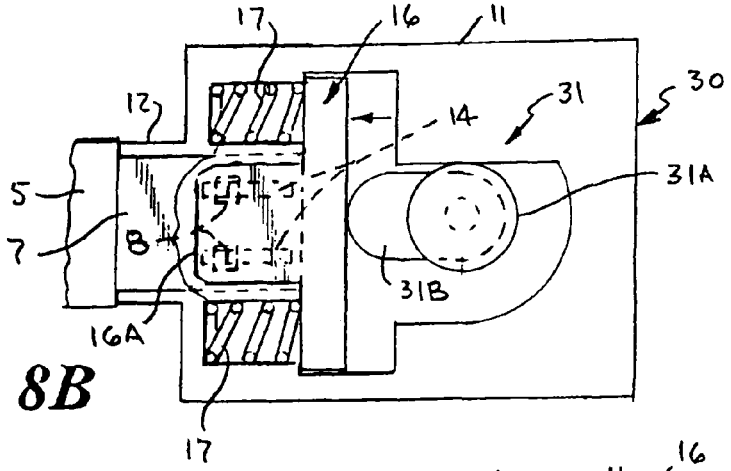
Figure 9B:
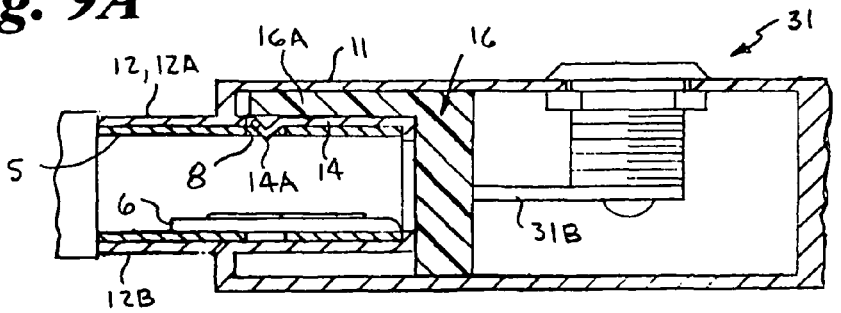

The male connector plug 5 is inserted into the receptacle 12 when the latch element 31 is in its unlocked position, rotated away from the inward facing surface of the retention member 16, until the protrusions 14A (or 14C) of the retention prongs 14 (or 14B) snap into and engage the holes 8 in the top surface of the plug 5, as shown in FIGS. 8B and 9B.

Whenever secure, locked engagement of the plug 5 with the lock 30 is desired, a key is inserted into the front of the lock mechanism 31 and turned such that its latch element 31B rotates ninety degrees, engages the inward facing surface of the retention member 16, and moves retaining member 16 outward such that its tongue portion 16A (or 16C) is moved to a locking position covering a sufficient portion of the retention prongs 14 (or 14B) to retain the protrusions 14A (or 14C) in the engaged position in the holes 8 of the plug 5 and the plug is captured within the receptacle in secure, locked engagement, and is incapable of being withdrawn until a key is again used to rotate the latch in the opposite direction.

Whenever the user desires to remove the lock 30 from secure engagement with the male connector plug 5, the key is inserted and the latch 31B is rotated in the opposite direction, thereby enabling the retaining member 16 to move inwardly relative to the housing 11 under pressure from the springs 17 from the locking position to the unlocked position such its tongue portion 16A (or 16C) uncovers a substantial portion of the retention prongs 14 (or 14B), and the plug 5 can be pulled outwardly relative to the receptacle to disengage the protrusions 14A (or 14C) and removed from the lock device.

Figure 10:
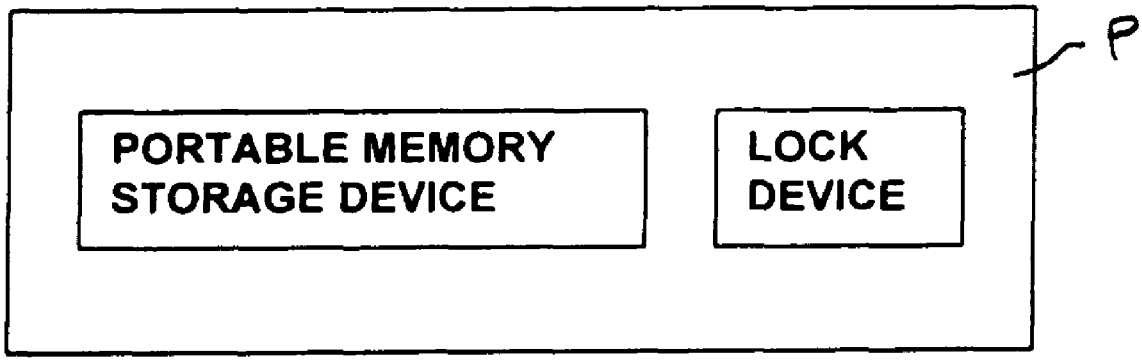
FIG. 10 is a schematic block diagram showing a memory storage device and a lock device therefor which may be provided together in combination as a kit.

As shown schematically in FIG. 10, the present lock device (any one of the embodiments described above) and a portable memory storage device may be provided together in combination in a package P and sold together as a kit for the convenience of the consumer.

The foregoing disclosure and description of the invention is illustrative and explanatory thereof. Various changes in the details of the illustrated construction and methods may be made within the scope of the appended claims without departing from the spirit of the invention. No limitations are intended to the details of construction or design, herein shown, or to the methods described herein, other than is described in the claims below. The present invention should only be limited by the following claims and their legal equivalents.

The invention claimed is:

1. A lock device for attachment to a male serial bus connector plug to prevent connection of the male connector plug having at least one hole to a mating female serial bus connector of another device, comprising:

a lock device;

a housing on said lock device;

a receptacle in said housing to receive and cover at least a portion of the male connector plug; and a locking mechanism in said housing moveable between an unlocked position allowing insertion and removal of a male connector plug from said receptacle, and a locked position preventing removal therefrom; and a member engaging said locking mechanism that moves axially so said locking mechanism engages in the at least one hole on the male connector plug when said locking mechanism is moved into the locked position by engaging holes in the male connector plug to prevent connection of the connector plug to a mating female serial bus connector of another device.

2. The lock device according to claim 1, wherein said receptacle receives a standard male Universal Serial Bus (USB) plug.

3. The lock device according to claim 1, wherein said locking mechanism comprises a combination lock mechanism.

4. The lock device according to claim 1, wherein said locking means comprises a key-operated lock mechanism.

5. The lock device according to claim 1, further comprising:

a cap-holding mechanism attached to said lock device for receiving and retaining a cap of a portable memory storage device.

6. The lock device according to claim 1, wherein the male serial bus connector plug is a standard USB A type connector plug disposed on a portable memory storage device; and said locking mechanism in its said locked position preventing removal therefrom with said receptacle covering at least a portion of the male connector plug to prevent connection of the connector plug with a mating female serial bus connector of another device and unauthorized access to data stored on the portable memory storage device.

7. The lock device according to claim 6, wherein said locking mechanism includes:

a shackle interconnected therewith movable between an unlocked condition and a locked condition for securing said lock device and the portable memory storage device in the locked condition to an object to prevent connection of the connector plug with a mating female serial bus connector and unauthorized access to data stored on the portable memory storage device.

8. The lock device according to claim 1, wherein said locking means comprises a lock mechanism and a retaining mechanism operatively connected with said lock mechanism and movable between a disengaged position and an engaged position by operation of said lock mechanism between said unlocked position and said locked position;

in its said disengaged position, said retaining mechanism allows insertion and removal of the male serial bus connector plug from said receptacle, and in its engaged position, said retaining mechanism prevents removal of the male serial bus connector plug from said receptacle; and said lock mechanism in its said locked position prevents movement of said retaining means to its said disengaged position.

9. The lock device according to claim 8, wherein said receptacle receives a standard male Universal Serial Bus (USB) A type connector plug disposed on a portable memory storage device; and said locking mechanism and retaining mechanism in said locked and engaged position preventing removal of the connector from said receptacle to prevent connection of the connector plug with a mating female serial bus connector of another device and unauthorized access to data stored on the portable memory storage device.

10. The lock device according to claim 8, wherein said lock mechanism comprises a combination lock mechanism having dial wheels, and a rod having a first end extending outwardly through one end of said housing to serve as a push button, a second end, and a mid portion interconnected with said combination lock mechanism which movably extends between an extended and retracted position in the unlocked condition, and is secured in the retracted position in the locked condition; said rod being moved to said retracted position by manually pressing said first end inwardly; and said retaining means is moved to its said engaged position by said rod second end as it is pressed inwardly.

11. The lock device according to claim 8, wherein said lock mechanism comprises a combination lock mechanism having dial wheels and a shackle having a leg interconnected with said combination lock mechanism which movably extends between an extended and retracted position in the unlocked condition, and is secured in the retracted position in the locked condition; and said retaining means is moved to its said engaged position by said shackle leg as it assumes its said retracted position.

12. The lock device according to claim 11, further comprising:

a cap-holding tether device having a first end adapted to be received on said shackle, and a male receptacle at a second end adapted to receive and engage a cap of a portable memory storage device.

13. The lock device according to claim 8, wherein said lock mechanism comprises a key-operated lock mechanism having a rotatable latch element engageable with said retaining means in said locked position; and said retaining means is moved to its said engaged position by said latch element as it rotates to its said locked position.

14. The lock device according to claim 8, wherein said receptacle has at least one resilient retention prong with a protrusion adapted to engage an aperture in the male serial bus connector plug when the connector plug is received therein, and said retaining mechanism is movable relative to said retention prong; said retaining mechanism in its said disengaged position disposed relative to said retention prong to allow said protrusion to be disengaged from the aperture and removal of the plug, and in its said engaged position disposed relative to said retention prong to a prevent disengagement of said protrusion from the aperture and removal of the plug.

15. The lock device according to claim 14, wherein said retaining mechanism comprises a retaining member slidably mounted in said housing and movable between a retracted position and an extended position relative to said retention prong and having a tongue portion disposed adjacent to said receptacle, which in said engaged position engages at least a portion of said retention prong to prevent disengagement of said protrusion from the aperture and removal of the plug.

16. The lock device according to claim 14, wherein said receptacle receives a standard male Universal Serial Bus (USB) plug having a case with at least one aperture; and said resilient retention prong protrusion is engages the aperture in the case when the connector plug is received therein.

17. A method for preventing connection of a male serial bus connector plug to a mating female serial bus connector, comprising the steps of:

providing a lock device having a receptacle that receives and covers at least a portion of the male connector plug, providing a locking mechanism moveable between an unlocked position allowing insertion and removal of the male connector plug from said receptacle, and a locked position preventing removal therefrom;

providing a member engaging said locking mechanism that is axially movable so said locking mechanism engages in at least one hole on the male connector plug to lock said receptacle onto the male connector plug;

positioning said receptacle of said lock device onto the male connector plug with the locking means in its unlocked position; and operating said locking mechanism to engage a hole in the male connector plug to prevent removal of the male connector plug from said receptacle, whereby at least a portion of the connector plug is captured within said receptacle to prevent connection of the male connector plug to the mating female serial bus connector.

18. The method according to claim 17, wherein said step of positioning said receptacle of said lock device onto the male connector plug includes:

positioning a standard USB A type connector plug disposed on a portable memory storage device;

said step of providing said locking mechanism includes providing a shackle interconnected therewith movable between an unlocked condition and a locked condition; and said step of operating said locking means to assume a locked position includes locking said shackle to an object to prevent unauthorized access to said connector plug when said lock device is in the locked condition.

19. A lockable memory storage device kit, comprising:

a memory storage device having a male serial bus connector plug;

a lock device having a housing engaging with said male serial bus connector plug; and a member engaging said lock device that moves axially so said locking mechanism engages in a hole in said male serial bus connector plug for selectively locking said lock device onto said male serial bus connector plug to prevent connection of said male serial bus connector plug to a mating female serial bus connector.

20. The lockable memory storage device kit according to claim 19, wherein said memory storage device is a portable memory storage device having a standard Universal Serial Bus (USB) A type connector plug; and said lock device includes a locking mechanism and a shackle interconnected therewith for securing said lock device to another object to prevent theft of said the portable memory storage device when said lock device is in the locked condition.

* * * * *